US006228570B1

(12) United States Patent
Freeman et al.

(10) Patent No.: US 6,228,570 B1
(45) Date of Patent: May 8, 2001

(54) PHOTOGRAPHIC ELEMENT WITH FLUOROPOLYMER LUBRICANTS

(75) Inventors: Dennis R. Freeman, Spencerport; Christine J. Landry-Coltrain, Fairport, both of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/452,356

(22) Filed: Dec. 1, 1999

(51) Int. Cl.[7] ..... G03C 1/85; G03C 1/76; G03C 11/06

(52) U.S. Cl. ..... 430/530; 430/140; 430/523; 430/527; 430/536; 430/531; 430/935; 430/961

(58) Field of Search ..... 430/140, 523, 430/536, 961, 935, 531, 527, 530

(56) References Cited

U.S. PATENT DOCUMENTS

| | | | | |
|---|---|---|---|---|
| 3,862,860 | * | 1/1975 | Pardee et al. | 430/961 |
| 3,998,989 | * | 12/1976 | Pardee et al. | 430/961 |
| 4,863,762 | * | 9/1989 | Aramaki et al. | 427/255.6 |
| 5,147,768 | | 9/1992 | Sakakibara | 430/501 |
| 5,217,804 | | 6/1993 | James et al. | 428/309 |
| 5,252,444 | | 10/1993 | Yamada et al. | 430/503 |
| 5,294,525 | * | 3/1994 | Yamauchi et al. | 430/523 |
| 5,432,050 | | 7/1995 | James et al. | 430/523 |
| 5,807,661 | * | 9/1998 | Landry-Coltrain | 430/523 |

OTHER PUBLICATIONS

Research Disclosure, vol. 176,Dec. 10, 1978, Item 17643.
Research Disclosure, vol. 365, Sep., 1994, Item 36544.
Polymer Handbook, Third Edition, J.Brandrup and E.H. Immergut, Eds., John Wiley & Sons, 1989, pp. V–42, V–48, and VII–385.

* cited by examiner

*Primary Examiner*—Richard L. Schilling
(74) *Attorney, Agent, or Firm*—Doreen M. Wells

(57) ABSTRACT

An photographic element comprising: a support with two sides; at least one sensitized layer on one side of the support; at least one transparent magnetic layer on another side of the support, opposite the sensitized layer; and a lubricant layer deposited on the transparent magnetic layer,wherein the lubricant layer is a fluorinated polymer selected from the group consisting of fluoropolymer resins, polytetrafluoroethylene, fluorinated ethylene polymer, fluorinated ethylene propylene, perfluoroalkoxy copolymer resins, and amorphous fluoropolymers.

17 Claims, No Drawings

PHOTOGRAPHIC ELEMENT WITH FLUOROPOLYMER LUBRICANTS

CROSS REFERENCE TO RELATED APPLICATIONS

This application relates to commonly assigned copending application Ser. No. 09/452,358, titled EVAPORATED LUBRICANTS FOR IMAGING ELEMENT,) filed simultaneously herewith.

FIELD OF THE INVENTION

The present invention is an imaging element containing a lubricant layer on the outermost surface opposite the sensitized layers, wherein the lubricant is a fluorinated polymer selected from the group consisting of fluoropolymer resins, polytetrafluoroethylene, fluorinated ethylene polymer, fluorinated ethylene propylene, perfluoroalkoxy copolymer resins, and amorphous fluoropolymers.

BACKGROUND OF THE INVENTION

Photographic and image or information recording media require adequate lubrication for the purposes of transport through recording devices, imaging devices (camera, photofinishing, thermal head, etc.) and scratch protection. Also, backing layers on photographic negative film that can be used to magnetically record, and subsequently, to retrieve, information require excellent lubrication at their surface to improve the durability of the recording layer. Contact between the magnetic head and the outermost surface of the backing layers of the film is necessary, however, this imposes a great amount of stress to the backing layers and may result in rupture of the layer, and in loss of signal. Good lubrication allows for multiple transports of the film through various magnetic head-containing equipment. The lubricant must also remain effective after the film has been run through photographic processing solutions. The present invention provides low coefficient of friction and, in addition, provides durability for excellent performance under a magnetic head. The lubricant layer is transparent and does not interfere with the transmission of light through the photographic element.

There are many known lubricating agents. Some are not soluble, some are soluble in limited solvents which impose constraints and difficulties for the coating of these lubricants and on manufacturing. In addition, the solvents used as vehicles for the wax may attack or cause damage or undesirable changes in the surface of the layer or layers onto which the lube is being coated. In addition, these carrier solvents may not be environmentally friendly.

Photographic elements containing transparent magnetic oxide coatings on the side opposite the photographic emulsions have been well- documented. The need for lubricating layers on said magnetic oxide coatings have also been well-described. A variety of types of lubricants have been disclosed including fatty acids, fatty acid esters, silicones, waxes, etc. In general, the transparent magnetic layer and the lubricating layer are applied in separate coating steps. This reduces the manufacturing efficiency of the product by requiring several coating stations. Typically these layers have been applied by first coating a solution of the magnetic oxide layer onto a support using a bead coating technique. The coating is then dried and a lubricant layer is then coated over the magnetic layer using a similar technique. Thus, another disadvantage is that the lubricant containing layer is typically applied using a solvent as a carrier, thus, generating solvent and solvent vapor waste.

Alternatively, the lubricant can be added to the magnetic oxide coating solution such that both the magnetics and lubricant are coated simultaneously. This is advantageous because less coating stations are required, likely reducing waste and simplifying the production. Unfortunately, in order for the lubricant to be effective it must primarily reside at the uppermost surface of the dry coating. When the lubricant is added to the magnetic oxide solution, it is difficult for the lubricant to get to the surface. As the solution dries rapidly, the polymeric binder for the magnetic oxide will vitrify or solidify, which retards the mobility of the lubricant. Additionally, the lubricant may also go to the support/magnetics interface instead of the desired magnetics/air interface. The result is an improperly lubricated surface, or a coating with a high coefficient of friction.

Another drawback of adding the lubricant directly to the magnetics layer is that phase separation can occur resulting in a translucent or opaque film. The lubricant can destabilize the magnetics dispersion, resulting in flocculation of the particles. Also, the lubricant may not be compatible with the magnetics binder, which can lead to gross phase separation and loss of optical transparency. It is desired to have the lubricant phase separate and migrate to the air interface, without the loss of optical transparency. Obviously a very selective phase separation is desired and is difficult to control. Alternatively, the lubricant may not be soluble, or dispersible in the same solvents as are needed for the components of the transparent magnetic layer.

U.S. Pat. No. 5,807,661 describes the incorporation of sub-micron fluorinated ethylene polymers into the transparent magnetic layer on photographic film. These can be coated combined within the magnetic layer, or, as a separate layer over the magnetic layer. The advantage of the use of these microparticles of PTFE and FEP is that their use is adaptable to manufacturing since they can be dispersed into environmentally friendly solvents that are amenable to coating the magnetic layer, such as alcohols, ketones, acetates, and water. The problems, however, are that the particulate nature of the fluorinated ethylene polymers may lead to these particles being dislodged from the coating during the magnetic head wearing process thus creating dusting and magnetic head clogging, which are undesirable. Another problem that arises when the lubricant is combined with the magnetic layer prior to coating, not enough lubricant will get to the surface and lubrication will be inefficient and inadequate.

U.S. Pat. No. 3,954,637 (5/76), U.S. Pat. No. 3,998,989 (12/76), and U.S. Pat. No. 3,862,860 (1/75) by Pardee et al., Ball Brothers Research Corporation describe the use of a tetrafluoroethylene (TFE) telomer for improving lubricity and abrasion resistance of photographic film. The above components are dissolved in a solvent and cast as a continuous film. The tetrafluoroethylene telomer is only soluble in highly fluorinated solvents which are environmentally unfriendly and not acceptable for coating manufacture. The solvent listed is trichlorotrifluoroethane. Other solvents suggested in the patent for the TFE telomer are 1,1,1-trichloroethane, trichloroethylene, tetrachloroethylene, chloroform, methylene chloride, carbon tetrachloride, dichloroethane, and dichloethylene. A TFE telomer is chemically different from high molecular weight polytetrafluoroethylene (PTFE) and has enhanced solubility over high molecular weight PTFE, such as that used in this invention. It is known that PTFE, FEP, and PFA polymers are not dissolvable in the above suggested solvents. "Polymer Handbook" third edition, J. Brandrup and E. H. Immergut, Eds., John Wiley & Sons, NY, 1989 (pages V-42, V-48, VII-385) states that PTFE and FEP and PFA are inert to essentially all common chemicals, and are only attacked by molten alkali metals, elemental fluorine, and pure oxygen at elevated temperatures. Sorption of solvents suggest that solutions of PTFE could be prepared in perfluorokerosene in the temperature range of 290–310° C.]. Thus, a lubricant layer of the fluorinated polymer of the present invention can not be achieved as described in U.S. Pat. No. 3,954,637 (5/76), U.S. Pat. No. 3,998,989 (12/76), and U.S. Pat. No. 3,862,860 (1/75).

U.S. Pat. No. 5,294,525 suggests that fluorine type lubricants can be used for the magnetic layer on silver halide photographic element. These lubricants are included in an extensive list of all possible lubricants. The invention does not provide any direction on how to reduce to practice the use of fluorocarbon type polymers on photographic film and, as will be later shown, reduction to practice presents problems.

U.S. Pat. No. 4,863,762 describes a physical vapor deposition technique that deposits fluororesins onto a surface. However, in this process, there is a need to degrade the molecular weight of the initial resin sample prior to the vacuum deposition process. This is done by heating the resin in the presence of a fluorine source. It would be preferable if the use of highly undesirable fluorine gas were not necessary.

JP1251349 A (New Nippon Electric Co) discusses a Magneto-optical recording medium that comprises an optically transparent substrate onto which a magnetic film is formed. A macromolecular film formed by plasma polymerization of tetrafluoroethylene monomer is formed on the surface-side dielectric substance film.

Vacuum deposition of PTFE-like substances involve starting with gaseous monomers and doing a plasma polymerization.

Plasma assisted polymerization of fluorinated monomers is not a feasible approach for providing the necessary lubrication for the transparent magnetic layer of the film because it leads to the degradation of the transparent magnetic layer and an increase in the coefficient of friction COF. As demonstrated herein, the use of plasma to assist either the vacuum deposition of preformed PTFE or FEP, or the polymerization of fluorinated hydrocarbon monomers, leads to degradation of the transparent magnetic layer and an increase in the coefficient of friction COF.

Results hereinbelow demonstrate that a lubricating layer can not be prepared by plasma polymerization of fluorinated monomers, onto the transparent magnetic layer of a photographic element. Therefore, although the element might have been mentioned in U.S. Pat. No. 5,294,525 as an idea only, there is still needed in the art a way to form a lubricating layer of fluoropolymers on a transparent magnetic layer.

SUMMARY OF THE INVENTION

In the present invention is described a means of obtaining a lubricating layer via deposition of the fluorinated polymer lubricant onto the dried magnetic layer via an evaporative process. This does not require solvents, does not require a solvent coating machine, and also ensures that the lubricant remains at the outermost surface of the transparent magnetic layer. A minimal amount of lubricant can be deposited with this method, so that lube transfer to the head will be minimized and head clogging problems reduced. Also, a lubricant layer comprised of lubricants that are not soluble or dispersible in solvents that are acceptable in industrial coating environments can be obtained.

The present invention provides a lubricating layer on an imaging element. The lubricant layer consists of a fluorinated polymer selected from the group consisting of fluoropolymer resins, polytetrafluoroethylene, fluorinated ethylene polymer, fluorinated ethylene propylene, perfluoroalkoxy copolymer resins, and amorphous fluoropolymers. The lubricant layer is applied in a deposition chamber. The chamber is evacuated to a pressure of $10^{-1}$ Torr or less. A carrier gas, preferably selected from the group consisting of $N_2$, $O_2$, Ar, is bleed into the chamber while maintaining the pressure in the chamber to 100 mTorr or less. The fluorinated polymer is heated to a temperature sufficient to vaporize the fluorinated polymer, and the imaging element is continuously moved through the chamber, depositing the fluorinated polymer on the imaging element to form the lubricating layer.

DETAILED DESCRIPTION OF THE INVENTION

A photographic support, coated with appropriate subbing, antistat, and magnetic oxide layers on the side opposite to the emulsion layers, is exposed, under vacuum, to a lubricant vapor phase. The lubricant vapor phase is obtained by heating the material to high enough temperatures to produce evaporation, or partial chemical breakdown, followed by evaporation. An appropriate background gas (such as argon, nitrogen, oxygen, etc.) is used to maintain a controlled atmosphere for the lubricant vapor phase to pass through as it deposits on the web. The side of the support that is coated with the vaporized lubricant is the side opposite to the emulsion layers.

Typical conditions for the deposition of the lubricant are a pressure of between 10–1000mT, preferably 100mT and a temperature within the range of 300° C. to 660° C. [for example, a temperature of 590° C. at 25 fpm, 660° C. at 200 fpm—rule of thumb here is a 10% increase in temperature (in degrees Kelvin) gives a 10X deposition rate increase]. Any carrier gas can be used, most typical gases are Nitrogen, Argon, or Oxygen. Any typical fluoripolymer lubricant can be used for this invention. In particular, typical fluoropolymers include fluorinated polymers selected from the group consisting of fluoropolymer resins, polytetrafluoroethylene, fluorinated ethylene polymer, fluorinated ethylene propylene, perfluoroalkoxy copolymer resins, and amorphous fluoropolymers.

Examples of fluorinated ethylene polymers can be selected from the group consisting of polytetrafluoroethylene (PTFE) resins such as Teflon® powders, micropowders, and fluoroadditive powders and fluorinated ethylene propylene (FEP) fluoropolymer resins [also called poly (tetrafluoroethylene-co-hexafluoropropylene)], perfluoroalkoxy (PFA) copolymer resins [also called poly (tetrafluoroethylene-co-perfluoro(alkylvinyl ether))] and amorphous fluoropolymers such as sold by DuPont and ICI Americas, Inc. Other examples of such particles are listed, but are not restricted to, are Fluoropolymer dispersions from ICI, such as those commercially sold under the names of AD1, AD133, AD2, AD639, AD730 and the like; Teflon® dispersions sold by DuPont under the names PFA 335, Teflon® FEP120, Teflon TE-3170, Teflon 30® [these can be dried to a powder form for the purpose of this invention]; Teflon® fluoroadditive powders sold by DuPont under the names MP1100, MP1150, and the like.

As mentioned earlier, plasma assisted polymerization of fluorinated monomers is not a feasible approach for providing the necessary lubrication for the transparent magnetic layer of the film because it leads to the degradation of the transparent magnetic layer and an increase in the coefficient of friction COF. As demonstrated herein, the use of plasma to assist either the vacuum deposition of preformed PTFE or FEP, or the polymerization of fluorinated hydrocarbon monomers, leads to degradation of the transparent magnetic layer and an increase in the coefficient of friction COF.

This is seen by the results in Tables I and II, where the coefficient of friction obtained for the vacuum deposition of FEP or PTFE is much higher for samples generated with the plasma on [plasma power=25 or 75 watts] than for samples generated with the plasma off [plasma power=0]. A COF less than 0.20 is desired.

TABLE I

PTFE Evaporated Samples.

| | Treatment Plasma Power (watts)/Pressure (mTorr)/gas | COF |
|---|---|---|
| PTFE | 0/30/Ar | 0.09 |
| PTFE | 25/30/Ar | 0.49 |
| PTFE | 75/30/Ar | 0.60 |
| PTFE | 0/80/Ar | 0.11 |
| PTFE | 25/80/Ar | 0.63 |
| PTFE | 75/80/Ar | 0.60 |
| PTFE | 0/150/Ar | 0.11 |
| PTFE | 25/150/Ar | 0.58 |
| PTFE | 75/150/Ar | 0.53 |
| PTFE | 0/30/O2 | 0.09 |
| PTFE | 25/30/O2 | 0.21 |
| PTFE | 75/30/O2 | 0.55 |
| PTFE | 0/80/O2 | 0.12 |
| PTFE | 25/80/O2 | 0.40 |
| PTFE | 75/80/O2 | 0.63 |
| no lube | Untreated | 0.60 |

PTFE: Polytetrafluoroethylene Grade Chemslip 42 aqueous dispersion from Chemical Corporation of America; dried under vacuum to remove the water.

TABLE II

FEP-T120 Evaporated Samples.

| | Treatment Plasma Power (watts)/Pressure (mTorr)/gas | COF |
|---|---|---|
| FEP | 0/30/Ar | 0.11 |
| FEP | 25/30/Ar | 0.31 |
| FEP | 75/30/Ar | 0.31 |
| FEP | 0/80/Ar | 0.16 |
| FEP | 75/80/Ar | 0.50 |
| FEP | 0/150/Ar | 0.14 |
| FEP | 75/150/Ar | 0.40 |
| FEP | 0/30/O2 | 0.14 |
| FEP | 75/30/O2 | 0.27 |
| FEP | 0/80/O2 | 0.18 |
| FEP | 75/80/O2 | 0.29 |
| FEP | 0/150/O2 | 0.16 |
| FEP | 75/150/O2 | 0.26 |
| FEP | 0/30/N2 | 0.14 |
| FEP | 25/30/N2 | 0.35 |
| FEP | 75/30/N2 | 0.34 |
| FEP | 0/80/N2 | 0.13 |
| FEP | 75/80/N2 | 0.26 |
| FEP | 0/150/N2 | 0.16 |
| FEP | 75/150/N2 | 0.28 |

FEP: Fluorinated ethylene propylene resin Grade FEP-T120 aqueous dispersion from DuPont; dried under vacuum to remove the water.

These results demonstrate that a lubricating layer can not be prepared by plasma polymerization of fluorinated monomers, onto the transparent magnetic layer of a photographic element by methods known heretofore.

The base support for the present invention can be cellulose derivatives such as a cellulose ester, cellulose triacetate, cellulose diacetate, cellulose acetate propionate, polyesters, such as polyethylene terephthalate or polyethylene naphthalate, poly-1,4-cyclohexanedimethylene terephthalate, polybutylene terephthalate, and copolymers thereof, polyimides, polyamides, polycarbonates, polystyrene, polyolefins, such as polyethylene, polypropylene, polysulfones, polyarylates, polyether imides and blends of these. The support typically employs an undercoat or a subbing layer well known in the art that comprises, for example, for a polyester support a vinylidene chloride/methyl acrylate/itaconic acid terpolymer or a vinylidene chloride/acrylonitrile/acrylic acid terpolymer.

The photographic elements according to this invention can contain one or more conducting layers such as antistatic layers and/or antihalation layers such as described in Research Disclosure, Vol. 176, December 1978, Item 17643 to prevent undesirable static discharges during manufacture, exposure and processing of the photographic element. Antistatic layers conventionally used for color films have been found to be satisfactory herewith. Any of the antistatic agents set forth in U.S. Pat. No. 5,147,768 which is incorporated herein by reference may be employed. Preferred antistatic agents include metal oxides, for example tin oxide, antimony doped tin oxide and vanadium pentoxide. These anitstatic agents are preferably dispered in a film forming binder.

The magnetic particles in the transparent magnetic layer can be ferromagnetic iron oxides, such as $\gamma$-$Fe_2O_3$, $\gamma$-$Fe_3O_4$, $\gamma$-$Fe_2O_3$ or $Fe_3O_4$ with Co, Zn or other metals in solid solution or surface treated or ferromagnetic chromium dioxides, such as $CrO_2$ with metallic elements, for example Li, Na, Sn, Pb, Fe, Co, Ni, and Zn, or halogen atoms in solid solution. Ferromagnetic pigments with an oxide coating on their surface to improve their chemical stability or dispersability, as is commonly used in conventional magnetic recording, may also be used. In addition, magnetic oxides with a thicker layer of lower refractive index oxide or other material having a lower optical scattering cross-section as taught in U.S. Pat. Nos. 5,217,804 and 5,252,444 can be used. These are present in the transparent magnetic layer in the amount from about 1 to 10 weight percent based on the weight if the binder. The magnetic particles have a surface area greater than 30 $m^2$/gm and a coverage of from about $1*10^{-11}$ mg/$\mu m^3$ to $1*10^{-10}$ mg/$\mu m^3$. A dispersing agent, or wetting agent can be present to facilitate the dispersion of the magnetic particles. This helps to minimize the agglomeration of the magnetic particles. Useful dispersing agents include fatty acid amines and commercially available wetting agents such as Witco Emcol CC59™ which is a quaternary amine available from Witco Chemical Corp. Rhodafac PE 510™, Rhodafac RE 610™, Rhodafac RE960™, and Rhodafac L00529™, which are phosphoric acid esters available from Rhone-Poulenc.

The polymer binder of the transparent magnetic layer may be any polymer having good abrasion resistance. For example, cellulose esters such as cellulose diacetates and triacetates, cellulose acetate propionate, cellulose acetate butyrate, cellulose nitrate, polyesters, polyacrylates such as polymethyl methacrylate, polyphenylmethacrylate and copolymers with acrylic or methacrylic acid, or sulfonates, polyesters, polyurethanes, urea resins, melamine resins, urea-formaldehyde resins, polyacetals, polybutyrals, polyvinyl alcohol, epoxies and epoxy acrylates, phenoxy resins, polycarbonates, vinyl chloride-vinyl acetate copolymers, vinyl chloride-vinyl acetate-vinyl-alcohol copolymers, vinyl chloride-vinyl acetate-maleic acid polymers, vinyl chloride-vinylidene chloride copolymers, vinyl chloride-acrylonitrile copolymers, acrylic ester-acrylonitrile copolymers, acrylic ester-vinylidene chloride copolymers, methacrylic ester-styrene copolymers, butadiene-acrylonitrile copolymers, acrylonitrile-butadiene-acrylic or methacrylic acid copolymers, styrene-butadiene copolymers can be used as binders in the transparent magnetic layer. Cellulose ester derivatives, such as cellulose diacetates and triacetates, cellulose acetate propionate, cellulose nitrate, polyesters, and polyacrylates such as polymethyl methacrylate, polyphenylmethacrylate and copolymers with acrylic or methacrylic acid are preferred.

Abrasive particles usefuil in the magnetic layer or lubricant layer include nonmagnetic inorganic powders with a Mohs scale hardness of not less than 6. These include, for example, metal oxides such as alpha-alumina, chromium oxide ($Cr_2O_3$), alpha-$Fe_2O_3$, silicon dioxide, alumino-silicate and titanium dioxide. Carbides such as silicone carbide and titanium carbide, nitrides such as silicon nitride, titanium nitride and diamond in fine powder may also be used. Alpha alumina and silicon dioxide are preferred. These are included to improve the head cleaning properties and improve durability of the coating. A dispersing agent, or wetting agent can be present to facilitate the dispersion of the abrasive particles. This helps to minimize the agglomeration of the particles. Useful dispersing agents include, but are not limited to, fatty acid amines and commercially available wetting agents such as Solsperse 24000™ sold by Zeneca, Inc. (ICI). The abrasive particles have a median diameter of about 0.2 to 0.4 $\mu$m. The abrasive particles are present in the lubricious overcoat layer, in the transparent magnetic layer or in both the overcoat and the transparent magnetic layer. They are present in the magnetic layer in the amount of at least 2 weight percent based on the weight of the binder so that durability of the coating is achieved and clogging of the magnetic heads is prevented. The upper limit of the amount of abrasive particles is determined by the loss of transparency of the layer, adversely affecting the photographic element, and by their abrasive effects on the magnetic heads and the tools and photographic apparatus that the film comes in contact with, leading to premature wear of these tools and apparatus. Typically, the abrasive particles are present in the transparent magnetic layer in the amount of 2 wt. % to about 20 wt % relative to the weight of the binder, and are present in the lubricating overcoat from about 0 wt. % to about 100 wt. %, relative to the weight of the lubricant in the overcoat.

Filler particles useful in the magnetic layer have a median diameter less than 0.15 $\mu$m, preferably less than 0.1 $\mu$m. The filler particles have a Mohs hardness greater than 6 and are present in the amount from about 0 to 300 percent, most preferably in the amount from about 0 to 85 percent based on the weight of the binder. Examples of filler particles include nonmagnetic inorganic powders such as δ-aluminum oxide, chromium oxide, iron oxide, tin oxide, doped tin oxide, silicon dioxide, alumino-silicate, titanium dioxide, silicon carbide, titanium carbide, and diamond in fine powder, as described in U.S. Pat. No. 5,432,050. A dispersing agent, or wetting agent can be present to facilitate the dispersion of the filler particles. This helps to minimize the agglomeration of the particles. Useful dispersing agents include, but are not limited to, fatty acid amines and commercially available wetting agents such as Solsperse 24000 sold by Zeneca, Inc. (ICI). Preferred filler particles are gamma-aluminum oxide and silicon dioxide.

The transparent magnetic layer may include coating aids and surfactants such as nonionic fluorinated alkyl esters such as FC-430, FC-431, FC-10, FC171 sold by Minnesota Mining and Manufacturing Co., Zonyl fluorochemicals such as Zonyl-FSN™, Zonyl-FTS™, Zonyl-TBS™, ZonylBA™ sold by DuPont; polysiloxanes such as Dow Coming DC 1248, DC200, DC510, DC 190 and BYK 320, BYK 322, sold by BYK Chemie and SF 1079, SF1023, SF 1054, and SF 1080 sold by General Electric; polyoxyehylene-lauryl ether surfactants sold by Kodak; sorbitan laurate, palmitate and stearates such as Span surfactants sold by Aldrich.

Viscosity modifiers can be present in the transparent magnetic layer. Such viscosity modifiers include high molecular weight cellulose esters, celluosics, acrylics, urethanes, and polyethylene oxides.

Solvents useful for coating the transparent magnetic layer of the present invention include alcohols, ketones, chlorinated solvents, esters, water, hydrocarbons, ethers, or mixtures thereof.

In a particularly preferred embodiment, the imaging elements of this invention are photographic elements, such as photographic films, photographic papers or photographic glass plates, in which the image-forming layer is a radiation-sensitive silver halide emulsion layer. Such emulsion layers typically comprise a film-forming hydrophilic colloid. The most commonly used of these is gelatin and gelatin is a particularly preferred material for use in this invention. Useful gelatins include alkali-treated gelatin (cattle bone or hide gelatin), acid-treated gelatin (pigskin gelatin) and gelatin derivatives such as acetylated gelatin, phthalated gelatin and the like. Other hydrophilic colloids that can be utilized alone or in combination with gelatin include dextran, gum arabic, zein, casein, pectin, collagen derivatives, collodion, agar-agar, arrowroot, albumin, and the like. Still other useful hydrophilic colloids are water-soluble polyvinyl compounds such as polyvinyl alcohol, polyacrylamide, poly (vinylpyrrolidone), and the like.

The photographic elements of the present invention can be simple black-and-white or monochrome elements comprising a support bearing a layer of light-sensitive silver halide emulsion or they can be multilayer and/or multicolor elements.

Color photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

A preferred photographic element according to this invention comprises a support bearing at least one blue-sensitive silver halide emulsion layer having associated therewith a yellow image dye-providing material, at least one green-sensitive silver halide emulsion layer having associated therewith a magenta image dye-providing material and at least one red-sensitive silver halide emulsion layer having associated therewith a cyan image dye-providing material.

In addition to emulsion layers, the photographic elements of the present invention can contain one or more auxiliary layers conventional in photographic elements, such as overcoat layers, spacer layers, filter layers, interlayers, antihalation layers, pH lowering layers (sometimes referred to as acid layers and neutralizing layers), timing layers, opaque reflecting layers, opaque light-absorbing layers and the like. The support can be any suitable support used with photographic elements. Typical supports include polymeric films, paper (including polymer-coated paper), glass and the like. Details regarding supports and other layers of the photographic elements of this invention are contained in Research Disclosure, Item 36544, September, 1994.

The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be, for example, tabular grain light-sensitive silver halide emulsions. The emulsions can be negative working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in Research Disclosure, Item 36544, September, 1994, and the references listed therein.

The photographic silver halide emulsions utilized in this invention can contain other addenda conventional in the photographic art. Useful addenda are described, for example, in Research Disclosure, Item 36544, September, 1994. Useful addenda include spectral sensitizing dyes, desensitizers, antifoggants, masking couplers, DIR couplers, DIR compounds, antistat agents, image dye stabilizers, absorbing materials such as filter dyes and UV absorbers, light-scattering materials, coating aids, plasticizers and lubricants, and the like.

Depending upon the dye-image-providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired.

Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

The present invention is illustrated by the following examples.

EXAMPLE 1

A transparent magnetic layer is prepared by coating solution A to a dry thickness of about 1.2 microns onto a support of subbed polyethylene terephthalate containing a vanadium pentoxide layer. The coating of solution A can be effected by any coating method known in the art. Solution A is generated by dispersing the magnetic particles (CSF-4085V2) and abrasive particles (E-600) in their respective solvents and respective stabilizing agents and adding these with a high shear mixer to a cellulose diacetate/cellulose triacetate solution in methylene chloride/acetone/methyl acetoacetate solvent mixture. A coating aid (optional), either FC-430 or FC-431, (3M Corporation) is added with low shear mixing. The composition of solution A is indicated in Table III below.

TABLE III

Composition of Solution A.

| Ingredient | Percent of Solution A |
|---|---|
| Cellulose diacetate [CA398-30] from Eastman Chemical Co. | 2.82 |
| Cellulose triacetate [CTA436-80S] from Eastman Chemical Co. | 0.125 |
| Rhodafac PE510 ™ surfactant | 0.006 |
| CSF-4085V2 from Toda Kogyo | 0.12 |
| E-600 from Norton Chemical | 0.08 |
| Solsperse 24000 ™ dispersant from Zeneca, Inc (ICI), | 0.004 |
| FC-431 from 3M Corporation | 0.02 |
| Dibutyl phthalate | 0.25 |
| Methylene chloride | 67.61 |
| Acetone | 24.15 |
| Methyl acetoacetate | 4.82 |

The coating is dried at temperatures to effectively remove all the solvent from the layer.

The lubricant layer is then applied to the dried transparent magnetic layer (TML) as follows. The experimental set-up (in a vacuum chamber) uses a 13.56 MHz RF generator and tuning network. The power from the RF generator is connected to an aluminum cathode. The web (with the TML coating) is the anode. The aluminum cathode, positioned just down-stream of the boat, has either a 1 inch diameter hole bored through its center, or a slit-lid (5 inch long X ¼ inch wide slit). Below this hole or slit is a tantalum boat that contains the solid lubricant and has a ⅜ inch diameter hole or slot in its lid. The boat has a thermocouple attached to it and is resistance heated while the temperature is monitored and maintained. The temperature is maintained to cause the source material (lubricant) to reach its vapor phase. This vapor deposits on the transporting web (while optionally passing through a plasma). In some instances there is no plasma. After the experiment has been done, the treated/coated web is removed from the vacuum chamber and sections are cut out and tested.

FEP-1 solid powder lubricant was placed in the tantalum boat in the described apparatus and heated to a temperature of between 300 and 320° C. The web with the dried transparent magnetic layer (TML) facing the lubricant-containing boat was transported at a fixed speed of 3 feet per minute above the boat. The carrier gas was Argon, at a pressure 30 mTorr.

The coefficient of friction (COF) of this final package was measured using standard known methods, such as those described in ASTM method designation: D 1894-78. For the practical purposes of the described invention either an IMASS Ball Sled friction tester or a paper clip friction tester. In the Ball Sled test, three tungsten balls are mounted in a triangular geometry onto a rigid support. The test sample is placed flat on another rigid support with the lubricious side of the sample facing upwards. The balls are then brought into contact with the test specimen and the sled is mechanically driven and set into horizontal motion, so that the test specimen and the balls are moving relative to each other. The force needed to sustain movement of the two surfaces relative to each other is measured and is related to the coefficient of friction (COF). A friction value less than 0.35, preferably less than 0.26, is desirable. The Paper Clip Friction test utilizes a U-shaped frictional slider cut from a steel paper clip. The rounded part of the slider contacts the sample in this test. A ¾" by 6" piece of the sample to be evaluated is secured on the inclined plane of the device, the lubricated surface facing upward. The inclined plane is then raised to an arbitrarily chosen angle (θ) and the frictional slider is placed on the sample. The paper clip assembly produces a load of 63.2 cos θ grams perpendicular to the sample surface. If the paper clip continuously slides down the coated sample, the angle of the inclined plane is decreased until the paper clip does not slide. The lowest angle in which the paper clip slides continuously down the sample corresponds to a COF which is determined from a calibrated scale on the inclined plane. The smaller the angle needed for the paper clip to continuously slide on the coated sample, the lower the COF.

The durability of the coating was tested with a rotating drum friction tester (RDFT) where a narrow (½ in) strip of the sample is placed in contact with a 4" diameter stainless steel drum utilizing a 180° wrap angle. One end of the sample is fixed and a 50 g load is placed on the other end of the sample. The lubricated side of the sample is in contact with the drum. The drum is rotated at 10.5"/sec and the friction between the drum and the sample is measured for a 10 minute time period. Desired results are a very flat and low friction ($\mu f$) vs time curve for the duration of the test. The test is repeated on three different portions of the coating. Samples that "pass" will endure the entire test, maintaining a low friction. Samples that "fail" show increasing friction with time during the test. The latter indicates insufficient lubrication of the surface of the coating, or a coating with poor physical properties.

The dried transparent magnetic layer of Example 1 had a measured COF of 0.10 and passed the RDFT test, as indicated in Table IV.

Table IV lists the results for other examples that were prepared as in Example 1, differing only by the composition of the lubricant. Different carrier gases were evaluated and the pressure used was varied between 1 mTorr and 1 Torr.

The transparent magnetic layer of Comparative example CE 11 was prepared as in Example 1, except that no lubricant layer was deposited onto it. The performance results are listed in Table IV.

TABLE IV

| | Lubricant | Carrier Gas | COF | RDFT |
|---|---|---|---|---|
| EX 1 | FEP-1 | Argon | 0.1 | pass |
| EX 2 | FEP-1 | Oxygen | 0.09 | pass |
| EX 3 | FEP-1 | Nitrogen | 0.09 | pass |
| EX 4 | FEP-2 | Nitrogen | 0.12 | pass |
| Ex 5 | FEP-2 | Oxygen | 0.14 | pass |
| EX 6 | PTFE-1 | Argon | 0.1 | pass |
| EX 7 | PTFE-1 | Oxygen | 0.12 | pass |
| EX 8 | PTFE-1 | Nitrogen | 0.09 | pass |
| EX 9 | PTFE-2 | Oxygen | 0.12 | pass |
| EX 10 | PTFE-2 | Nitrogen | 0.23 | pass |
| CE 11 | none | none | >0.5 | fail |

FEP-1: Fluorinated ethylene propylene resin Grade FEP-T120 aqueous dispersion from DuPont; dried under vacuum to remove the water.
FEP-2: Fluorinated ethylene propylene resin Grade FEP100 pellets from DuPont.
PTFE-1: Polytetrafluoroethylene Grade Chemslip 42 aqueous dispersion from Chemical Corporation of America; dried under vacuum to remove the water.
PTFE-2: polytetrafluoroethylene Grade 8A powder from DuPont.

The invention has been described in detail with particular reference to certain preferred embodiments thereof, but it will be understood that variations and modifications can be effected within the spirit and scope of the invention.

What is claimed is:

1. A photographic element comprising:

a support with two sides;

at least one sensitized layer on one side of the support;

at least one transparent magnetic layer on another side of the support, opposite the sensitized layer; and a lubricant layer vapor deposited on the transparent magnetic layer, wherein the lubricant layer is a fluoropolymer resin.

2. A photographic element comprising:

a support having on one side a sensitized layer and on another side, opposite the sensitized layer, a transparent magnetic layer and an outermost lubricant layer, wherein the lubricant layer is formed by vapor depositing, in a deposition chamber, on the transparent magnetic layer a fluoropolymer resin.

3. The photographic element of claim 1 or 2 wherein the lubricating layer is formed by:

providing in a deposition chamber a fluoropolymer resin;

pressurizing the chamber to a pressure of $10^{-1}$ Torr or less;

bleeding a carrier gas into the chamber while maintaining the pressure in the chamber to 100 milli torr or less;

heating the polymer to a temperature sufficient to vaporize the fluoropolymer resin;

moving the imaging element through the chamber on a continuously moving web; and depositing the fluoropolymer resin on the element to form a lubricating layer.

4. The element of claim 1, 2, or 3 wherein the fluoropolymer resin is polytetrafluoroethylene.

5. The element of claim 1, 2, or 3 wherein the fluoropolymer resin is fluorinated ethylene propylene.

6. The photographic element of claim 1, 2, or 3 wherein the fluoropolymer resin is a high density polyethylene.

7. The photographic element of claim 1, 2, or 3 wherein the fluoropolymer resin is heated within a range of 300° C. and 660° C.

8. The photographic element of claim 3 wherein the gas in the deposition chamber is selected from Argon, Nitrogen and Oxygen.

9. The photographic element of claim 1, 2, or 3 further having at least one optional layer selected from subbing, antistat, and magnetic oxide layers.

10. The photographic element of claim 9 wherein the antistat layer includes metal oxides.

11. The photographic element of claim 10 wherein the metal oxide is selected from tin oxide, antimony doped with tin oxide and vanadium pentoxide.

12. The photographic element of claim 1 wherein the transparent magnetic layer contains magnetic particles.

13. The photographic element of claim 1 wherein the magnetic particles have a surface area greater than 30 m2/gm.

14. The photographic element of claim 12 wherein the magnetic particles are present in the transparent magnetic layer in an amount between 1 and 10 weight percent based on the weight of a binder present in the magnetic layer.

15. The photographic element of claim 1, 2, or 3 wherein the fluororesin is a fluorinated ethylene polymer.

16. The photographic element of claim 1, 2, or 3 wherein the fluororesin is a perfluoroalkoxy copolymer resin.

17. The photographic element of claim 1, 2, or 3 wherein the fluororesin is an amorphous fluoropolymer.

* * * * *